US011047597B2

(12) United States Patent
Tsai et al.

(10) Patent No.: US 11,047,597 B2
(45) Date of Patent: Jun. 29, 2021

(54) ELECTRIC HOT WATER HEATER HAVING A SEPARATED TEMPERATURE SENSOR AND HEATING ELEMENT

(71) Applicant: Haier US Appliance Solutions, Inc., Wilmington, DE (US)

(72) Inventors: Craig Iung-Pei Tsai, Louisville, KY (US); Alan George Constance, Jeffersonville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 214 days.

(21) Appl. No.: 16/106,111

(22) Filed: Aug. 21, 2018

(65) Prior Publication Data

US 2020/0064023 A1 Feb. 27, 2020

(51) Int. Cl.

| | |
|---|---|
| ***F24H 9/20*** | (2006.01) |
| ***F24H 9/18*** | (2006.01) |
| ***F24H 1/20*** | (2006.01) |

(52) U.S. Cl.

CPC ..... *F24H 9/2021* (2013.01); *F24H 1/201* (2013.01); *F24H 9/1818* (2013.01)

(58) Field of Classification Search

None

See application file for complete search history.

(56) References Cited

U.S. PATENT DOCUMENTS

| | | | | |
|---|---|---|---|---|
| 2,266,210 | A * | 12/1941 | Osterheld | G05D 23/27541 392/464 |
| 4,692,592 | A * | 9/1987 | Kale | F28D 20/0039 392/450 |
| 5,168,546 | A * | 12/1992 | Laperriere | F24D 17/0073 122/14.22 |
| 6,560,409 | B2 | 5/2003 | Troost, IV | |
| 6,785,466 | B1 * | 8/2004 | Jackson | F24H 1/202 392/450 |
| 7,712,677 | B1 | 5/2010 | Munsterhuis et al. | |
| 8,061,308 | B2 | 11/2011 | Phillips | |
| 2004/0161227 | A1 * | 8/2004 | Baxter | F24H 9/2021 392/454 |
| 2007/0108187 | A1 * | 5/2007 | Ding | H05B 3/82 219/492 |
| 2007/0127899 | A1 * | 6/2007 | Friedrich | F24H 9/2021 392/441 |
| 2008/0107409 | A1 * | 5/2008 | Lesage | F24H 1/202 392/454 |
| 2011/0079611 | A1 * | 4/2011 | Verhoeven | A47J 31/56 222/129.3 |

(Continued)

*Primary Examiner* — Tu B Hoang
*Assistant Examiner* — Masahiko Muranami
(74) *Attorney, Agent, or Firm* — Dority & Manning, P.A.

(57) ABSTRACT

An electric water heater appliance is provided herein. The electric water heater appliance may include a tank, an electric heating element, and a temperature sensor. The tank may define an interior volume extending from a top portion to a bottom portion. The interior volume may define a volume height along a vertical direction between the bottom portion and the top portion. The electric heating element may be operable to heat water within the interior volume. The temperature sensor may be attached to the tank above the electric heating element. A sensor gap may be defined along the vertical direction between the electric heating element and the temperature sensor.

17 Claims, 3 Drawing Sheets

(56) References Cited

U.S. PATENT DOCUMENTS

| | | | | |
|---|---|---|---|---|
| 2013/0193221 | A1* | 8/2013 | Buescher | H05B 1/0297<br>237/8 A |
| 2013/0202277 | A1* | 8/2013 | Roetker | F24H 4/04<br>392/441 |
| 2016/0040906 | A1* | 2/2016 | Aguilar | F24H 1/201<br>392/451 |

* cited by examiner

ELECTRIC HOT WATER HEATER HAVING A SEPARATED TEMPERATURE SENSOR AND HEATING ELEMENT

FIELD OF THE INVENTION

The present subject matter relates generally to water heater appliances, and more particularly to water heater appliances having one or more electric heating elements or temperature sensors.

BACKGROUND OF THE INVENTION

Certain water heater appliances include a tank therein. Heating elements heat water within the tank during operation of such water heater appliances. In particular, the heating elements generally heat water within the tank to a predetermined temperature. The predetermined temperature is generally selected such that heated water within the tank is suitable for showering, hand washing, etc.

During operation, relatively cool water flows into the tank, and the heating elements operate to heat such water to the predetermined temperature. Thus, the volume of heated water available at the predetermined temperature is generally limited to the volume of the tank. Accordingly, water heater appliances are sold in various sizes to permit consumers to select a proper tank volume and provide sufficient heated water.

Common water heater appliances provide a heating element mounted together with an electromechanical temperature sensor in the bottom half of the tank. The electromechanical temperature sensor is generally positioned 1 to 3 inches above the heating element and activates or deactivates the heating element according to a predetermined temperature threshold. If the electromechanical temperature sensor detects a temperature below the predetermined temperature threshold, the heating element may be activated. If the electromechanical temperature sensor detects a temperature above the predetermined temperature threshold, the heating element may be deactivated.

Although the close proximity between the heating element and the electromechanical temperature sensor may facilitate easy installation of the heating element and electromechanical temperature sensor, the design also presents a number of drawbacks. For instance, the water heater appliance may be especially prone to temperature stacking within the tank. In other words, significant variations in temperature may be formed within the tank. Relatively small water draws, such as those caused by hand washing, may cause water adjacent to the electromechanical temperature sensor and heating element to fall below the predetermined temperature threshold, thereby leading to activation of the heating element, even though most of the water within the tank may be above the predetermined temperature threshold. Oftentimes, this causes the heating element to overheat the water above the desired temperature, especially if the heating element is a relatively high power heating element, which quickly heats water within the water heater tank. In turn, a slug of water near the top of the water tank may rise to a temperature well above predetermined temperature threshold. Having this hot water slug may then lead to high and variable hot water temperatures above the set temperature being supplied by the water heater appliance during a subsequent water draw. Along with affecting variation of hot water temperatures from the water heater appliance, this may increase cycling of the heating elements, which may in turn decrease the reliability and useful life of the heating element.

As a result, there is a need for improved water heater appliances. In particular, it would be useful and advantageous to provide a water heater appliance addressing one or more of the above identified issues.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an electric water heater appliance is provided. The electric water heater appliance may include a tank, an electric heating element, and a temperature sensor. The tank may define an interior volume extending from a top portion to a bottom portion. The interior volume may define a volume height along a vertical direction between the bottom portion and the top portion. The electric heating element may be operable to heat water within the interior volume. The temperature sensor may be attached to the tank above the electric heating element. A sensor gap may be defined along the vertical direction between the electric heating element and the temperature sensor. A ratio of the sensor gap over the volume height may be equal to or greater than 0.1.

In another exemplary aspect of the present disclosure, an electric water heater appliance is provided. The electric water heater appliance may include a tank, a lower electric heating element, an upper electric heating element, a lower temperature sensor, and an upper temperature sensor. The tank may define an interior volume extending from a top portion to a bottom portion. The interior volume may define a volume height along the vertical direction between the bottom portion and the top portion. The lower electric heating element may be operable to heat water within the interior volume. The upper electric heating element may be positioned above the lower electric heating element and operable to heat water within the interior volume. The lower temperature sensor may be attached to the tank above the lower electric heating element and below the upper electric heating element. The upper temperature sensor may be attached to the tank above the upper electric heating element. A lower sensor gap may be defined along the vertical direction between the lower electric heating element and the lower temperature sensor. An upper sensor gap may be defined along the vertical direction between the upper electric heating element and the upper temperature sensor. The lower sensor gap may be greater than the upper sensor gap.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
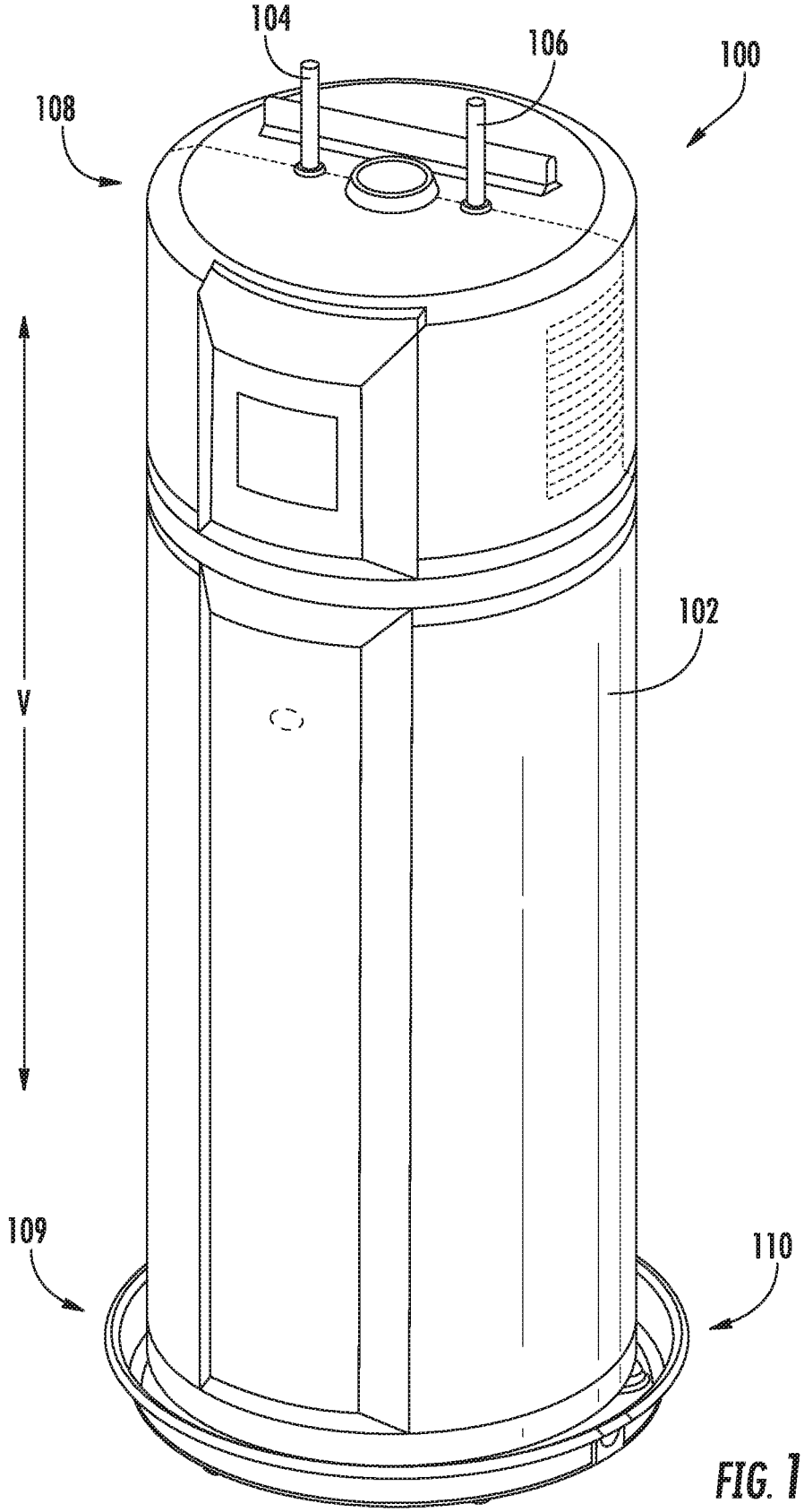
FIG. 1 provides a perspective view of a water heater appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Figure 2:
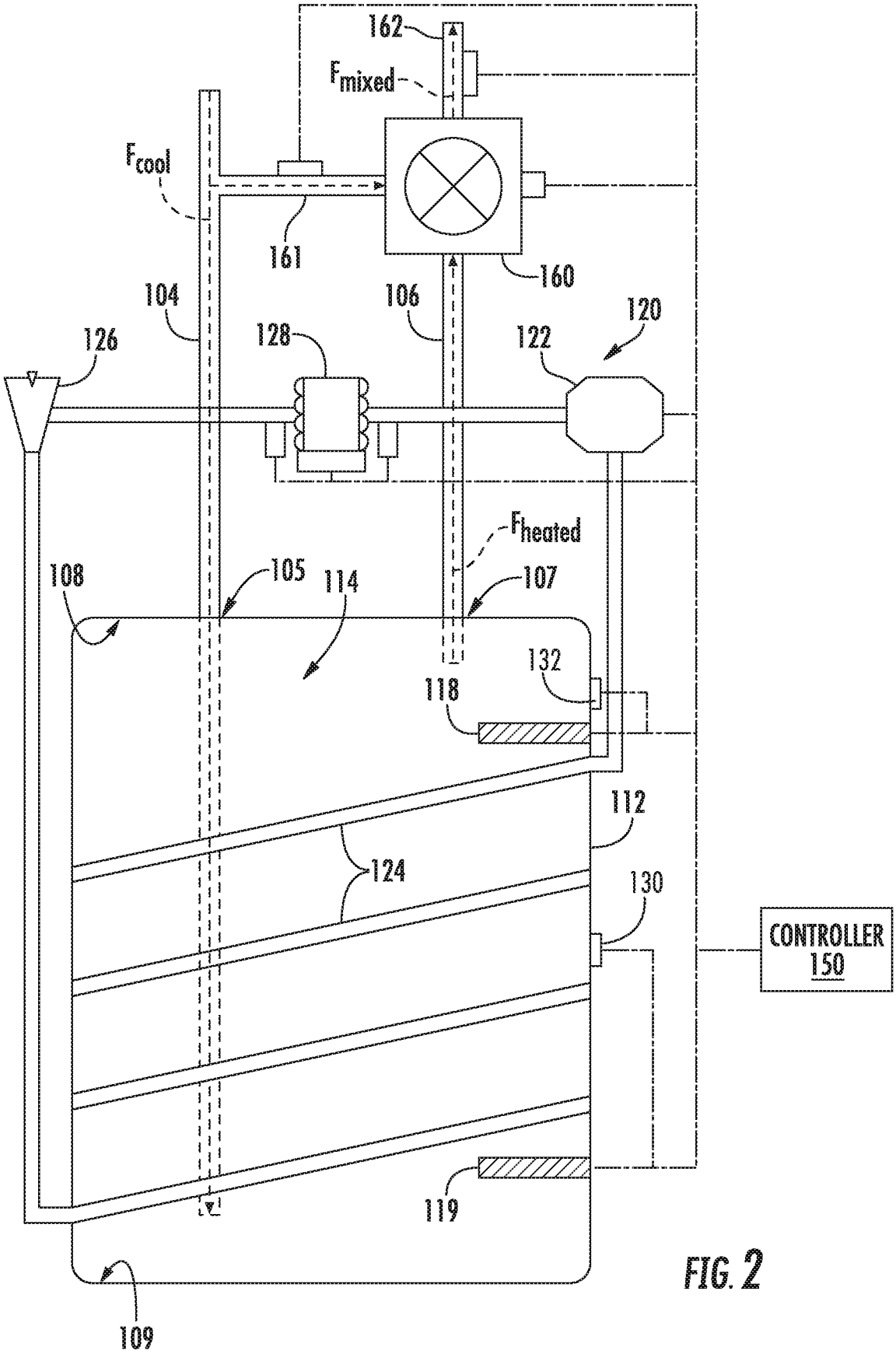
FIG. 2 provides a schematic view of certain components of the exemplary water heater appliance of FIG. 1.
Figure 3:
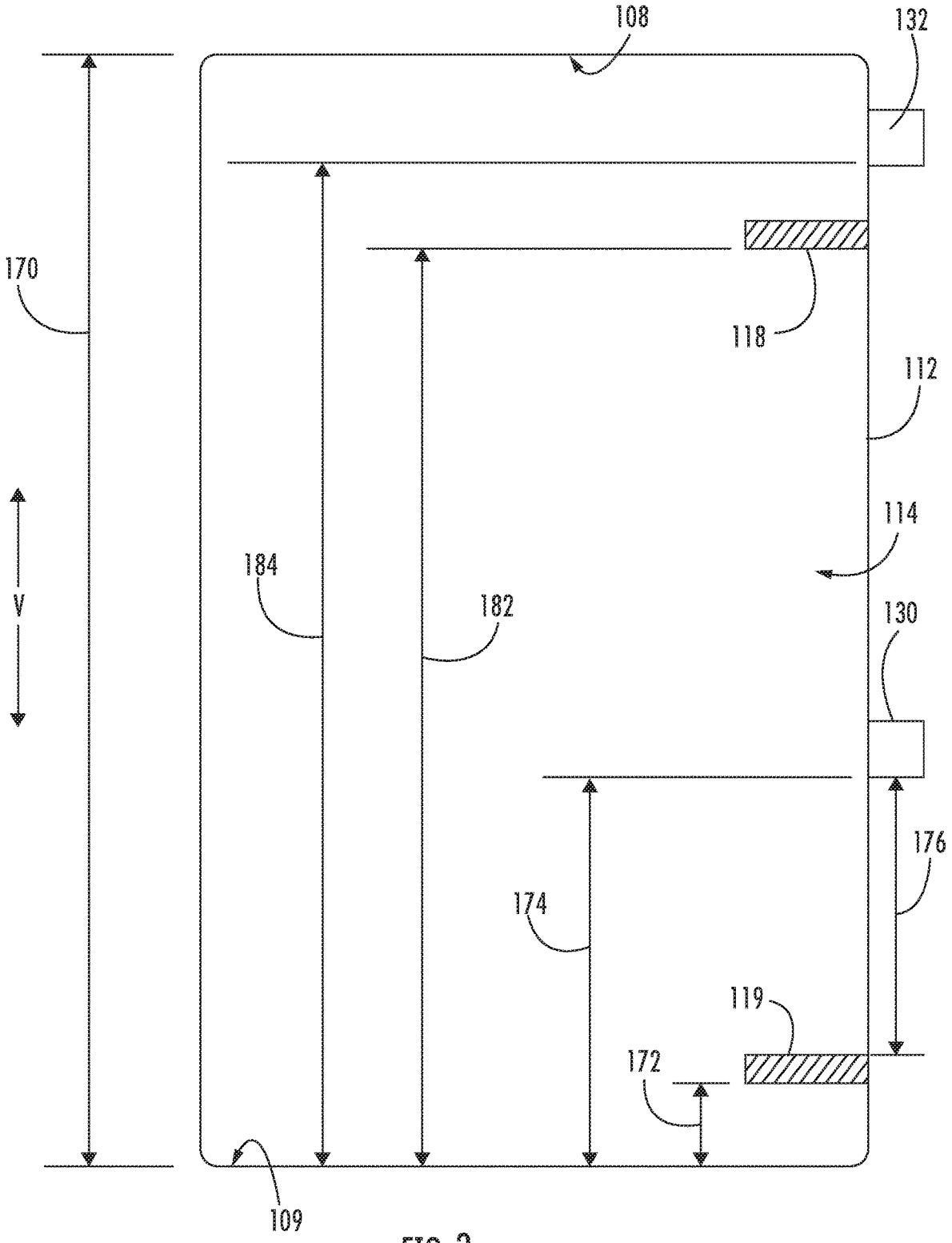
FIG. 3 provides another schematic view of certain components of the exemplary water heater appliance of FIG. 1.

Turning now to the figures, FIG. 1 provides a perspective view of a water heater appliance 100 according to an exemplary embodiment of the present subject disclosure. FIGS. 2 and 3 provide schematic views of certain components of water heater appliance 100. As may be seen in FIGS. 1 through 3, water heater appliance 100 includes a casing 102 and a tank 112 mounted within casing 102. Tank 112 defines an interior volume 114 for heating water therein.

Water heater appliance 100 also includes an inlet conduit 104 and an outlet conduit 106 that are both in fluid communication with tank 112 within casing 102. As an example, cold water from a water source, such as a municipal water supply or a well, enters water heater appliance 100 through inlet conduit 104 (e.g., at an inlet 105 extending through an upper portion of tank 112). From inlet conduit 104, such cold water enters interior volume 114 of tank 112 wherein the water is heated to generate heated water. Such heated water exits water heater appliance 100 at outlet conduit 106 (e.g., supplied through an outlet 107 at an upper portion of tank 112) and, for example, is supplied to a bath, shower, sink, or any other suitable feature.

As shown, interior volume 114 of tank 112 extends between a top portion 108 and a bottom portion 109 along a vertical direction V. Thus, water heater appliance 100 is generally vertically oriented. Water heater appliance 100 can be leveled (e.g., such that casing 102 is plumb in the vertical direction V) in order to facilitate proper operation of water heater appliance 100.

In certain embodiments, a drain pan 110 is positioned at bottom portion 109 of water heater appliance 100 such that water heater appliance 100 sits on drain pan 110. Drain pan 110 sits beneath water heater appliance 100 along the vertical direction V (e.g., to collect water that leaks from water heater appliance 100 or water that condenses on an evaporator 128 of water heater appliance 100). It should be understood that water heater appliance 100 is provided by way of example only and that the present subject matter may be used with any suitable water heater appliance.

Turning especially to FIGS. 2 and 3, water heater appliance 100 generally includes one or more electric heating elements, such as an upper heating element 118 or a lower heating element 119, for heating water within interior volume 114 of tank 112. Upper and lower heating elements 118 and 119 can be any suitable heating elements. For example, upper heating element 118 or lower heating element 119 may be an electric resistance element, an induction element, or any other suitable electric heating element or combination thereof. In optional embodiments, a sealed system 120 is further provided on or about tank 112 to heat water within interior volume 114.

In certain embodiments, sealed system 120 includes a compressor 122, a condenser 124, a throttling device 126, and an evaporator 128. Condenser 124 is thermally coupled or assembled in a heat exchange relationship with tank 112 in order to heat water within interior volume 114 of tank 112 during operation of sealed system 120. In particular, condenser 124 may be a conduit coiled around and mounted to tank 112. During operation of sealed system 120, refrigerant exits evaporator 128 as a fluid in the form of a superheated vapor or high quality liquid vapor mixture. Upon exiting evaporator 128, the refrigerant enters compressor 122 wherein the pressure and temperature of the refrigerant are increased such that the refrigerant becomes a superheated vapor. The superheated vapor from compressor 122 enters condenser 124 wherein it transfers energy to the water within tank 112 and condenses into a saturated liquid or high quality liquid vapor mixture. This high quality/saturated liquid vapor mixture exits condenser 124 and travels through throttling device 126 that is configured for regulating a flow rate of refrigerant therethrough. Upon exiting throttling device 126, the pressure and temperature of the refrigerant drop at which time the refrigerant enters evaporator 128 and the cycle repeats itself. In certain exemplary embodiments, throttling device 126 may be an electronic expansion valve (EEV).

As shown, water heater appliance 100 includes one or more tank temperature sensors, such as a first temperature sensor 130 (e.g., lower temperature sensor) and a second temperature sensor 132 (e.g., upper temperature sensor). Generally, tank temperature sensors 130, 132 are configured for measuring a temperature of water within interior volume 114 of tank 112 and can be any suitable temperature sensing device (e.g., in operative communication with the controller 150). For example, one or more tank temperature sensors 130, 132 may be provided as a thermocouple, thermistor, or electromechanical temperature-dependent switch (e.g., bimetal switch). When assembled, one or more tank temperature sensors 130, 132 may be positioned within interior volume 114 of tank 112 or may be mounted to tank 112 outside of interior volume 114 of tank 112. When mounted to tank 112 outside of interior volume 114 of tank 112, a tank temperature sensor (e.g., first temperature sensor 130 or second temperature sensor 132) can be configured for indirectly measuring the temperature of water within interior volume 114 of tank 112. For example, tank temperature sensors 130, 132 can measure the temperature of tank 112 and correlate the temperature of tank 112 to the temperature of water within interior volume 114 of tank 112.

Water heater appliance 100 further includes a power source or controller 150 that is configured for regulating operation of water heater appliance 100 (e.g., by selectively directing electrical power energy from a connected power grid). Controller 150 is in, for example, operative communication (e.g., electrical communication through one or more conductive wires/busses) with upper heating element 118, lower heating element 119, compressor 122, or tank temperature sensors 130, 132. Thus, controller 150 may selectively activate upper and lower heating element 118 and 119 or compressor 122 in order to heat water within interior volume 114 of tank 112. As an example, controller 150 may activate/deactivate heating elements 118, 119 directly in response to signals from temperature sensors 130, 132. As another example, controller 150 may activate/deactivate heating elements 118, 119 indirectly by supplying an electrical current separately to heating elements 118, 119 through respective temperature sensors 130, 132; the temperature sensors 130, 132 being configured to open or close the electrical path therethrough (i.e., restrict or permit electrical current to the respective heating element 118 or 119) in response to a detected temperature.

In some embodiments, controller 150 includes memory (e.g., non-transitive media) and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 150 may operate upper heating element 118, lower heating element 119, or compressor 122 in order to heat water within interior volume 114 of tank 112. As an example, a user may select or establish a predetermined set temperature, $t_s$, for water within interior volume 114 of tank 112, or the set temperature $t_s$ for water within interior volume 114 of tank 112 may be a default value (e.g., selected during design or assembly of water heater appliance 100). Based upon the set temperature $t_s$ for water within interior volume 114 of tank 112, controller 150 may selectively activate upper heating element 118, lower heating element 119, or compressor 122 in order to heat water within interior volume 114 of tank 112 to the set temperature $t_s$ for water within interior volume 114 of tank 112.

In certain embodiments, detection of a temperature at first temperature sensor 130 that is below the set temperature $t_s$ prompts activation of lower heating element 119 (e.g., by closing a temperature-dependent switch at first temperature sensor 130 such that an electrical current is permitted to lower heating element 119). Detection of a temperature that is above the set temperature $t_s$ prompts restriction of lower heating element 119 (e.g., by opening a temperature-dependent switch at first temperature sensor 130 such that electricity is withheld from lower heating element 119). In additional or alternative embodiments, detection of a temperature at the second temperature sensor 132 that is below the set temperature $t_s$ prompts activation of upper heating element 118 (e.g., by closing a temperature-dependent switch at second temperature sensor 132 such that an electrical current is permitted to upper heating element 118). Detection of a temperature that is above the set temperature $t_s$ prompts restriction of upper heating element 118 (e.g., by opening a temperature-dependent switch at second temperature sensor 132 such that an electrical current is withheld from upper heating element 118).

The set temperature $t_s$ for water within interior volume 114 of tank 112 may be any suitable temperature. For example, the set temperature $t_s$ for water within interior volume 114 of tank 112 may be between about one hundred degrees Fahrenheit and about one hundred and eighty-degrees Fahrenheit. As used herein with regards to temperature approximations, the term "about" means within ten degrees of the stated temperature.

In optional embodiments water heater appliance 100 also includes a mixing valve 160 and a mixed water outlet conduit 162. Mixing valve 160 may be in fluid communication with inlet conduit 104 via a bypass conduit 161, tank 112, and mixed water outlet conduit 162. As would be understood, mixing valve 160 may be configured for selectively directing water from inlet conduit 104 and tank 112 into mixed water outlet conduit 162 in order to regulate a temperature of water within mixed water outlet conduit 162. Mixing valve 160 may be positioned or disposed within casing 102 of water heater appliance 100 (e.g., such that mixing valve 160 is integrated within water heater appliance 100).

Turning especially to FIG. 3, the vertical positions of one or more of the electric heating elements (e.g., upper heating element 118 or lower heating element 119) or one or more of the temperature sensors 130, 132 (e.g., first temperature sensor 130 second temperature sensor 132) may be preset along tank 112 for advantageous operation of water heater appliance 100. In particular, heating elements 118, 119 and temperature sensors 130, 132 may be provided at predetermined locations along the volume height 170 of interior volume 114, which is defined along the vertical direction V between bottom portion 109 and top portion 108.

In certain embodiments, first temperature sensor 130 is attached to tank 112 at a location above lower heating element 119. Lower heating element 119 may thus define a lower element height 172 (e.g., vertical distance between lower heating element 119 and bottom portion 109) that is less than a first sensor height 174 defined by first temperature sensor 130 (e.g., vertically between first temperature sensor 130 and bottom portion 109). Moreover, a sensor gap 176 (e.g., lower sensor gap) may be defined along the vertical direction V between lower heating element 119 and first temperature sensor 130. As shown, sensor gap 176 may further define a vertical distance within which no other electrical heating element is provided. Thus, the region of interior volume 114 through which sensor gap 176 is defined may be free of any electrical heating elements—even so, sensor gap 176 may span a portion of a condenser 124 along tank 112 between lower heating element 119 and temperature sensor 130, as illustrated in FIG. 2.

Sensor gap 176 may be defined according to a predetermined ratio of relative vertical heights. As an example, a gap ratio of the sensor gap 176 over the volume height 170 [i.e., (176)/(170)] may be predetermined as a value greater than or equal to 0.1. Additionally or alternatively, the gap ratio of the sensor gap 176 over the volume height 170 may be defined as a value greater than or equal to 0.2. Optionally, the gap ratio of the sensor gap 176 over the volume height 170 may be defined as a value between 0.2 and 0.5. Advantageously, the described gap ratios may ensure an even heat distribution within interior volume 114 and prevent excessive cycling of lower heating element 119.

As shown, upper heating element 118 and second temperature sensor 132 may both define vertical heights above first temperature sensor 130. In certain embodiments, upper heating element 118 defines an upper element height 182 (e.g., vertical distance between upper heating element 118 and bottom portion 109) that is less than a second sensor height 184 defined by second temperature sensor 132 (e.g., vertically between second temperature sensor 132 and bottom portion 109). Optionally, an upper sensor gap may be defined along the vertical direction V between the upper heating element 118 and the second temperature sensor 132 (e.g., as the difference between second sensor height 184 and upper element height 182) as a value less than sensor gap 176 (i.e., the lower sensor gap). In other words, the lower sensor gap 176 may be greater than the upper sensor gap between upper heating element 118 and the second temperature sensor 132. Additionally or alternatively, a separation ratio of the first sensor height 174 over the upper element height 182 [i.e., (174)/(182)] may be defined as a value between 0.3 and 0.8. Advantageously, the positioning of second temperature sensor 132 may ensure temperature detection of first temperature sensor 130 is not undesirably affected by heat generated at upper heating element 118.

In exemplary embodiments, a base height ratio of the lower element height 172 over the volume height 170 [i.e., (172)/(170)] may be predetermined as a value less than or equal to 0.2. Additionally or alternatively, the base height ratio may be defined as a value less than or equal to 0.1. Optionally, the base height ratio may be defined as a value between 0.2 and 0. Advantageously, the base height ratios may ensure lower heating element 119 is positioned proximate to bottom portion 109 and prevents any cold-water slug from forming therebelow. Moreover, the above-described embodiments may ensure water heater appliance 100 is able to meet various required energy usage standards (e.g. mandated by the United States government) while heating water in, for example, substantially all of interior volume 114.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An electric water heater appliance defining a vertical direction, the electric water heater appliance comprising:

a tank defining an interior volume extending from a top portion to a bottom portion, the interior volume defining a volume height along the vertical direction between the bottom portion and the top portion;

an electric heating element within the interior volume operable to heat water within the interior volume; and a temperature sensor attached to the tank above the electric heating element;

wherein a sensor gap is defined along the vertical direction as a vertical distance between the electric heating element and the temperature sensor, wherein a ratio of the sensor gap over the volume height is between 0.2 and 0.5, wherein an element height is defined along the vertical direction as a vertical distance between the bottom portion and the electric heating element, and wherein a ratio of the element height over the volume height is between 0.2 and 0.

2. The electric water heater appliance of claim 1, wherein the electric heating element is a resistance heating element extending through the tank into the interior volume.

3. The electric water heater appliance of claim 1, wherein the temperature sensor is a temperature-dependent switch in electrical communication with the electric heating element.

4. The electric water heater appliance of claim 1, wherein the temperature sensor is configured to restrict activation of the electric heating element in response to detection of a predetermined set temperature.

5. The electric water heater appliance of claim 1, wherein the electric heating element is a lower electric heating element, and wherein the electric water heater appliance further comprises an upper electric heating element positioned above the lower electric heating element and operable to heat water within the interior volume.

6. The electric water heater appliance of claim 1, wherein the temperature sensor is a lower temperature sensor, and wherein the electric water heater appliance further comprises an upper temperature sensor attached to the tank above the lower temperature sensor.

7. The electric water heater appliance of claim 1, further comprising a sealed system operable to heat water within the tank, the sealed system comprising a compressor, a condenser, an expansion device and an evaporator charged with refrigerant.

8. The electric water heater appliance of claim 1, wherein the ratio of the element height over the volume height is equal to or less than 0.1.

9. An electric water heater appliance defining a vertical direction, the electric water heater appliance comprising:

a tank defining an interior volume extending from a top portion to a bottom portion, the interior volume defining a volume height along the vertical direction between the bottom portion and the top portion;

a lower electric heating element operable to heat water within the interior volume;

an upper electric heating element positioned above the lower electric heating element and operable to heat water within the interior volume;

a lower temperature sensor attached to the tank above the lower electric heating element and below the upper electric heating element; and an upper temperature sensor attached to the tank above the upper electric heating element, wherein a lower sensor gap is defined along the vertical direction as a vertical distance between the lower electric heating element and the lower temperature sensor, wherein an upper sensor gap is defined along the vertical direction as a vertical distance between the upper electric heating element and the upper temperature sensor, wherein the lower sensor gap is greater than the upper sensor gap, and wherein a ratio of the lower sensor gap over the volume height is between 0.2 and 0.5, wherein an upper element height is defined along the vertical direction as a vertical distance between the bottom portion and the upper electrical heating element, wherein a lower sensor height is defined along the vertical direction between the bottom portion and the lower temperature sensor, and wherein a ratio of the upper element height over the lower sensor height is between 0.3 and 0.8.

10. The electric water heater appliance of claim 9, wherein the ratio of the lower sensor gap over the volume height is equal to or greater than 0.2.

11. The electric water heater appliance of claim 9, wherein the lower electric heating element or the upper electric heating element is a resistance heating element extending through the tank into the interior volume.

12. The electric water heater appliance of claim 9, wherein the lower temperature sensor is a temperature-dependent switch in electrical communication with the lower electric heating element.

13. The electric water heater appliance of claim 12, wherein the upper temperature sensor is a temperature-dependent switch in electrical communication with the upper electric heating element.

14. The electric water heater appliance of claim 9, wherein the lower temperature sensor is configured to restrict activation of the lower electric heating element in response to detection of a threshold temperature at the lower temperature sensor, and wherein the upper temperature sensor is configured to restrict activation of the upper electric heating element in response to detection of the threshold temperature at the upper temperature sensor.

15. The electric water heater appliance of claim 9, further comprising a sealed system operable to heat water within the tank, the sealed system comprising a compressor, a condenser, an expansion device and an evaporator charged with refrigerant.

16. The electric water heater appliance of claim 9, wherein a lower element height is defined along the vertical direction between the bottom portion and the lower electric heating element, and wherein a ratio of the lower element height over the volume height is equal to or less than 0.2.

17. The electric water heater appliance of claim 16, wherein the ratio of the lower element height over the volume height is equal to or less than 0.1.

* * * * *